United States Patent [19]

Conrad et al.

[11] Patent Number: 4,472,221

[45] Date of Patent: Sep. 18, 1984

[54] METHOD AND APPARATUS FOR TREATING AN EMBROIDERED ARTICLE

[75] Inventors: Bernhard Conrad, Weaverville; Erich H. Conrad, Asheville, both of N.C.

[73] Assignee: Conrad Industries, Inc., Weaverville, N.C.

[21] Appl. No.: 408,187

[22] Filed: Aug. 16, 1982

[51] Int. Cl.[3] ..... B29D 23/05

[52] U.S. Cl. ..... 156/83; 156/285; 156/382

[58] Field of Search ..... 156/83, 72, 148, 284, 156/285, 382, 497, 575, 580; 42/78, 266.1; 264/343; 428/187, 913.3

[56] References Cited

U.S. PATENT DOCUMENTS

| | | | |
|---|---|---|---|
| 3,615,976 | 10/1971 | Endres et al. | 156/83 |
| 3,816,211 | 6/1974 | Haigh | 428/187 |
| 3,925,127 | 12/1975 | Yoshioka | 156/83 |
| 4,140,563 | 2/1979 | Sernaker | 156/148 |

*Primary Examiner*—Caleb Weston

*Attorney, Agent, or Firm*—David M. Carter

[57] ABSTRACT

A method and apparatus are disclosed for treating a textile article which has raised embroidery on its front side. A plastic sheet is laminated to the back side of the textile article by the application of heat and pressure. Moisture is applied to the front side of the article so that the embroidery which may have been flattened by the lamination process is returned to its original raised condition.

8 Claims, 7 Drawing Figures

METHOD AND APPARATUS FOR TREATING AN EMBROIDERED ARTICLE

BACKGROUND OF THE INVENTION

This invention relates to embroidered textile articles. More particularly it relates to a method and apparatus for treating a textile article having a normally raised embroidery which has been flattened during processing.

In the manufacture of emblems for patches and the like, lettering and logo are embroidered on a sheet of flat textile material using threads and yarns of varying thicknesses. The patterns of embroidery are often repeated, creating a thickness or raised embroidery on the front side of the emblem. The raised embroidery creates a three-dimensional pictorial effect presenting a more visually acceptable product for the end user than if the lettering or logo were merely painted or stitched on the textile article or if the embroidery were flattened for some reason.

Once the emblem with the raised embroidery has been created, it has been found necessary to add stiffness to the product because of the tendency for the emblem to warp or curl. In order to add stiffness to the emblem, several methods have been devised. One method is to add starch to the emblem, however, this method is difficult to control properly and is rather labor intensive. Another method is to laminate a plastic backing onto the back side of the emblem by the application of heat and pressure. While this method is very efficient in that it is subject to automated processes, it has been found that the raised embroidery is flattened during the lamination process, thus altering the three-dimensional appearance of the emblem and reducing its marketability.

OBJECTS OF THE INVENTION

It is therefore one object of this invention, to provide a method for treating an embroidered article.

It is another object of this invention to provide an apparatus for treating an embroidered article.

It is still another object to provide a method and apparatus for raising the embroidery on a laminated textile article.

It is still another object to provide an embroidered emblem with the proper stiffness yet presenting an acceptable appearance.

SUMMARY OF THE INVENTION

In accordance with one form of this invention there is provided a method and apparatus for treating an article which has raised embroidery on its front side. A plastic sheet is laminated to the back side of the article by applying heat and pressure to the plastic sheet and to the article. Moisture is applied to the front side of the article. If the embroidery has been flattened in the laminating process, the moisture will cause it to return to its original raised condition.

In another form of the invention set forth above a means to prevent the excess accumulation of moisture on the article is provided.

BRIEF DESCRIPTION OF THE DRAWINGS

The subject matter which is regarded as the invention is set forth in the appended claims. The invention itself, however, together with further objects and advantages thereof can be better understood by reference to the following description taken in conjunction with the accompanying drawings in which:

DESCRIPTION OF THE PREFFERRED EMBODIMENT

Figure 1:
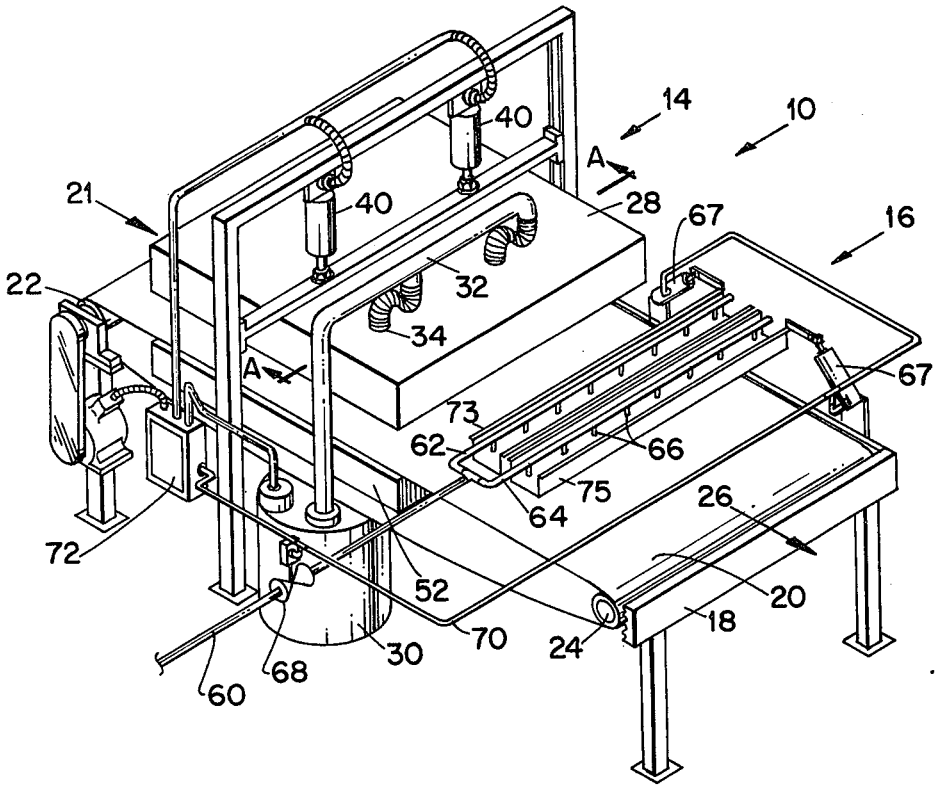
FIG. 1 is a partial pictorial view of an apparatus useful in the performance of the subject invention.
Figure 3:
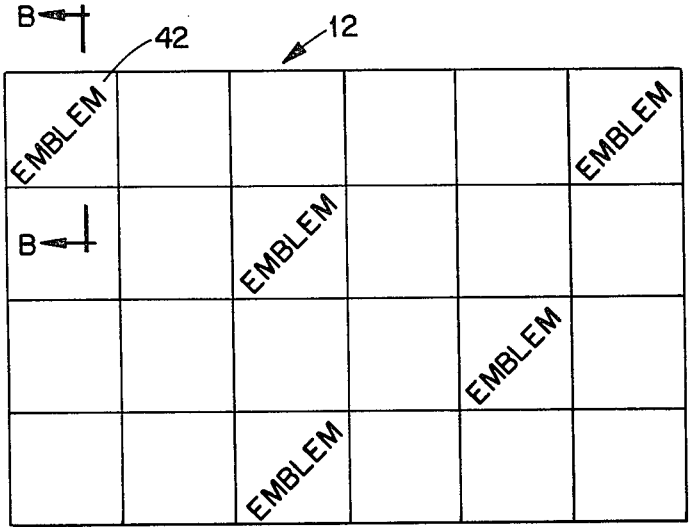
FIG. 3 is a plan view showing the top of a plurality of emblems which are to be treated by the apparatus and process of the subject invention.

Referring now more particularly to FIG. 1, there is provided apparatus 10 for the treatment of embroidered articles such as the plurality of emblems 12, which are shown in FIG. 3. Apparatus 10 includes lamination section 14 and moisture application section 16, which are mounted on table 18. Belt 20 in the form of a web is mounted on rollers 22 and 24 for transporting the workpieces from the lamination section to the moisture application section. Belt 20 covers the substantial width and length of table 18. The belt moves in the direction of arrow 26 so that the workpieces are first subject to the lamination section and then made subject to the moisture section. The lamination section 14 includes a housing 28, which is connected to vacuum source 30 by hose 32. Hose 32 is attached to opening 34 in the top of housing 28.

Figure 2:
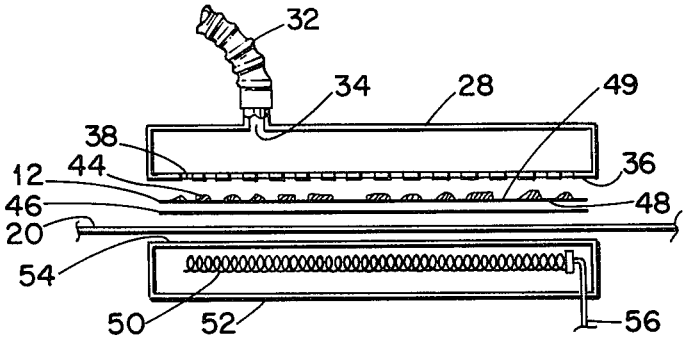
FIG. 2 is a sectional view of a portion of the apparatus of FIG. 1 taken through Section A—A and further showing the work pieces.

Referring now to FIG. 2, the bottom portion of housing 28 is formed by pressure plate 36, having a plurality of holes 38 therethrough. Pressure plate 38 makes contact with the tops of embroidered article 12 during lamination. The housing and pressure plate 38 are raised and lowered by pneumatic system 40 which is shown in FIG. 1. FIG. 2 shows the housing 28 in its raised condition. As can be seen from FIG. 2, embroidered article 12 contains a plurality of emblems 42, as shown in FIG. 3. These emblems are embroidered and prior to the lamination process have raised lettering and/or logo 44 as shown in the cross section in FIG. 2. A sheet of plastic material 46, which may be made of polyethylene, polyamide or other fusible films is shown in FIG. 2 contacting the bottom side 48 of embroidered article 12. This sheet of plastic material is to be laminated to the back side of embroidered article 12 to add stiffness to the final product. Heat is applied during the lamination process by resistance heating element 50 which is contained in housing 52. Heating element 50 is connected to a suitable source of electrical energy through conductors 56. The top portion 54 of housing 52 also acts as a pressure plate against the underside of belt 20, which in turn presses against plastic sheet 46 during the lamination process. The heat from the heating element 50 is transferred through pressure plate 54, belt 20 and onto plastic sheet 46. The lamination of the plastic sheet to the embroidered article is accomplished when the heating element 50 is turned on and housing 28 is lowered onto the top of embroidered article 44 with the vacuum source 30 being on.

Figure 4:
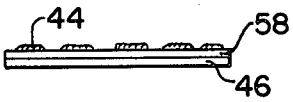
FIG. 4 is a sectional view of one of the emblems of FIG. 3 taken to Section B—B prior to one of the final steps of the process of this invention.

It is this lamination process that causes the flattening of the formerly raised embroidery 44. This may be seen better in reference to FIG. 4, which shows textile material 58 laminated to plastic sheet 46 with the embroidery 44 having been flattened. FIG. 4 is a sectional view of the emblem 42 taken through section line B—B after the lamination step but prior to the addition of moisture to the emblem.

Referring now to the moisture addition section 16 of FIG. 1, there is provided a water pipe 60 which is connected to a suitable water source. The water pipe is further connected to two pipe branches 62 and 64, each having connected thereto a plurality of water spigots 66. The spigots 66 could alternatively be mounted on short pipes connected between a pair of parallel pipes over each shield which is described below. Moisture actuation valve 68 connects water pipe 60 to the spickets 66 through pipe branches 62 and 64. Valve 68 may be actuated by a solenoid or, as shown in this embodiment, a pneumantic line 70 which is connected to a master control 72. The master control 72 is a standard electronic circuit which controls rollers 22, the actuation of vacuum source 30, the movement up and down of housing 28, the application of heat from resistance heater 50, the application of moisture through spigots 66 and the movement of drip shields 73 and 75 which are described below. This master control is a standard electronic item which is commercially available from the Square D Company.

Figure 7:
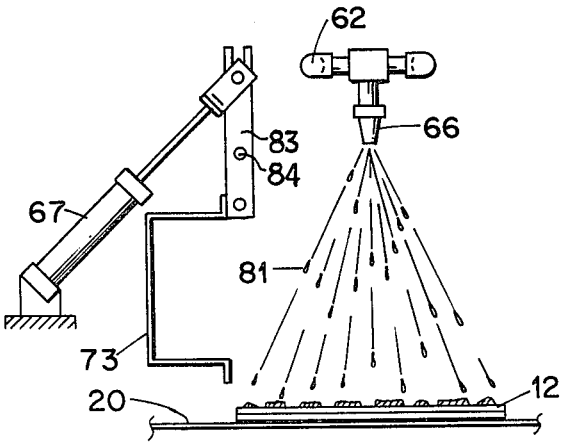
FIG. 7 is a side view showing the drip shield of FIG. 6 with the shield down.
Figure 6:
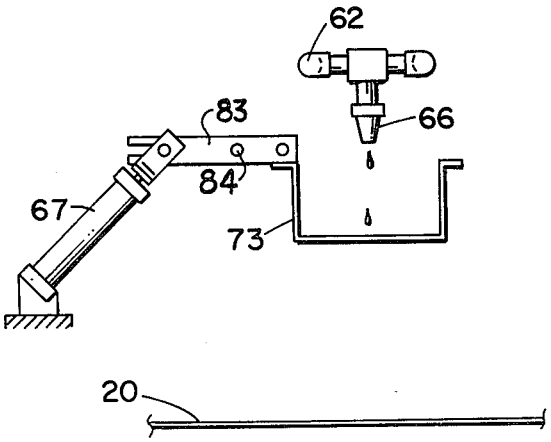
FIG. 6 is a side view showing one of the drip shields shown in FIG. 1 with the shield up.

Since this embodiment is non-continuous, one of the problems associated with the above system is the accumulation of excess moisture on the embroidered article 12 due to drippings from spigots 66. Shields are provided to overcome this excess moisture problem. A pair of drip shields 73 and 75 are rotatably located under pipes 62 and 64 and are rotated 90 degrees by pistons 67. Pistons 67 are connected to pneumatic lines 70. As shown in FIG. 6, the shield 73 is connected to piston 67 by arms linkage 83. Linkage 83 may be mounted on a pivot rod, the end of which is shown as 84 in FIGS. 6 and 7, but is not shown in FIG. 1 so that the important portions of the apparatus may more easily be observed. FIGS. 1 and 6 show the shields in the up position for catching water which often inadvertently drips from spigots 66. FIG. 7 shows one of the shields 73 in its down position rotated 90 degrees with respect to its down position. As can be seen, the down position of the shield permits full application of a fine spray of moisture 81 to the embroidered article 12.

Each shield may be tilted somewhat with respect to its longitudinal axis to permit the collected water to drain out of a hole which may be drilled in the bottom of one end. The spigots 66 are standard spigots adapted to apply a fine spray to the previously flattened embroidered article 12 after it comes out of the lamination section 14. The spigots 66 are commercially available from the Sprayco Company.

Figure 5:
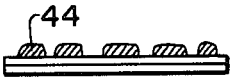
FIG. 5 is the same view as FIG. 4, but after one of the final steps of the process of this invention.

Normally within two minutes after the application of moisture to the emblem shown in FIG. 4, the embroidery returns to its original raised condition as shown in FIG. 5. It is believed that this occurs primarily because the moisture, upon hitting the hot laminated article, quickly turns to steam and enables the return of the embroidery to its original condition due to the memory of the yarn used in the embroidery. Normally the yarns which are used in the embroidery are made of rayon, polyester or cotton materials.

The apparatus described above operates in conjunction with the workpieces as follows: A sheet of emblems 12 is contacted on its back side 48 by a sheet of plastic material 46. The emblems and plastic sheet are placed on roller 20 at the input end 21 of apparatus 10. The plastic sheet is situated between the back side 48 of emblems 12 and belt 20. The sheet of plastic and the sheet of emblems are aligned with one another. The electronic controls 72 are actuated causing the rollers to drive the belt 20 in the direction of arrow 26. When the plastic sheet and emblems align with the bottom pressure plate 36 of housing 28, the belt stops its forward movement. Heater 50 is then actuated and housing 28 is lowered such that pressure plate 36 contacts the top side 49 of emblem sheet 12. Housing 28 is evacuated by vacuum pump 30 which causes further pressure on the top side of 49 of emblems 12 and since the emblems are made of a textile material they are somewhat porous, permitting air to pass through. Thus the vacuum forces the now hot plastic material 46 into very intimate contact with the back side 48 of the emblems. The plastic material is thusly laminated to the emblems 12. Electronic controls then cause the reservoir 28 to be raised by pneumantic pistons 40.

The embroidery 44 on the emblems is now in its flattened condition as shown in FIG. 4, due to this lamination process. The belt drive is then actuated causing belt 20 to move in the direction of arrow 26 and the emblems to be transported directly underneath the moisture addition section 16 with the drip shields 73 and 75 in the up position, as shown in FIG. 1, during transport. Pneumantic pistons 67 force the drip shields 73 and 75 into their down position and water valve 68 is opened, permitting a fine spray of water through spigots 66 to completely cover all of the embroidery on the emblem sheet 12 as shown in FIG. 7. Steam is formed on the emblems causing the embroidery 44 to quickly come back to their original raised condition as shown in FIG. 5. Valve 68 then terminates the spray of water and pistons 67 force the shields to their up position to collect moisture drips from spigots 66. The belt is again actuated causing the emblems to be moved off the apparatus 10 to an inventory holding area.

From the foregoing description of the preferred embodiment of the invention, it is apparent that many modifications may be made therein. For example, the invention while specifically designed for embroidered emblems is useful in the treatment of any embroidered article where the object is to provide a three-dimensional type embroidery display. Thus it is intended that the appended claims cover all such modifications that fall within the true spirit and scope of this invention.

I claim:

1. A process for treating an article having raised embroidery on its front side comprising the steps of:

contacting the back side of said embroidered article with a heat-respnsive backing; applying heat to said backing; forcing said article and said backing into intimate contact whereby the raised embroidery on said article becomes somewhat flattened; applying moisture to said article whereby said embroidery returns to its original raised condition; preventing excess moisture from contacting the embroidered article.

2. The process as set forth in claim 1, wherein the step of preventing includes moving a moisture collection means between the embroidered article and a moisture application source.

3. A process for treating an article which has raised embroidery on its front side comprising the steps of:

laminating a plastic sheet to the back side of said article by applying heat and pressure to said plastic sheet and to said article; applying moisture in the form of a fine spray of water from a spigot to the front side of said article whereby the embroidery which has been flattened by the laminating step is returned to its original raised condition; terminating the fine spray of water; placing a drip collection means between the article and the water spigot.

4. An apparatus for treating an article which has raised embroidery on its front side comprising:

means for laminating a plastic sheet to the back side of said article; said means for laminating including means for applying heat and means for applying pressure to said plastic sheet and said article; said means for applying pressure includes a housing connected to a vacuum source and a bottom plate having a plurality of holes therein, said bottom plate adapted to contact the front side of said article while said article and said plastic sheet are heated; means for applying moisture to the front side of said article, whereby the embroidery which has been flattened by said means for laminating is returned to its original raised condition.

5. An apparatus for treating an article which has raised embroidery on its front side comprising:

means for laminating a plastic sheet to the back side of said article; said means for laminating including means for applying heat and means for applying pressure to said plastic sheet and said article; means for applying moisture to the front side of said article, whereby the embroidery which has been flattened by said means for laminating is returned to its original raised condition; said means for applying moisture includes a plurality of spigots located adjacent to said means for applying pressure.

6. An apparatus for treating an article which has raised embroidery on its front side comprising:

means for laminating a plastic sheet to the back side of said article; said means for laminating including means for applying heat and means for applying pressure to said plastic sheet and said article; means for applying moisture to the front side of said article whereby the embroidery which has been flattened by said means for laminating is returned to its original raised condition; means for preventing excess moisture from being applied to said article; said means for preventing excess moisture being temporarily located in a path between said article and said means for applying moisture.

7. An apparatus as set forth in claim 6, wherein said means for preventing excess moisture is temporarily located outside of said path upon actuation of said means for applying moisture.

8. An apparatus as set forth in claim 6, wherein said means for preventing excess moisture is at least one trough shaped shield and said means for applying moisture includes a water pipe and at least one spigot; said shield being rotatably mounted under said water pipe.

* * * * *